United States Patent [19]

Nabstedt et al.

[11] Patent Number: 4,636,763

[45] Date of Patent: Jan. 13, 1987

[54] BOBBIN WITH STRAIN RELIEF

[75] Inventors: Elmer J. Nabstedt, Montvale, N.J.; Raymond H. Van Wagener, Darien, Conn.

[73] Assignee: Universal Manufacturing Corporation, N.J.

[21] Appl. No.: 710,982

[22] Filed: Mar. 12, 1985

[51] Int. Cl.[4] ..... H01C 15/10; H01C 41/04

[52] U.S. Cl. ..... 336/192; 29/602 R; 29/605; 174/135; 336/208; 339/105

[58] Field of Search ..... 336/192, 198, 208; 174/135, 168; 339/103 R, 103 M, 105, 223 R; 29/602 R, 605; 310/71

[56] References Cited

U.S. PATENT DOCUMENTS

| | | | |
|---|---|---|---|
| 536,684 | 4/1895 | Creager | 174/168 |
| 546,585 | 9/1895 | Dibb et al. | 174/168 |
| 587,273 | 7/1897 | Rudolf | 174/168 |
| 4,157,519 | 6/1979 | Foster | 336/192 |

*Primary Examiner*—Thomas J. Kozma
*Attorney, Agent, or Firm*—Darby & Darby

[57] ABSTRACT

A bobbin for use in an inductive device is provided. The bobbin has an integral strain relief member including first and second sections having colinear passageways, the first and second sections being separated by a gap. A locking member located in the gap engages a lead wire previously inserted through the passageways and sets the engaged portion of the lead wire off the colinear axis of the passageways.

20 Claims, 13 Drawing Figures

BOBBIN WITH STRAIN RELIEF

BACKGROUND OF THE INVENTION

1. Field of the Invention

This invention relates generally to bobbins for inductive devices and more particularly to bobbins having integral strain relief elements or an entirely separate strain relief element to be inserted.

2. Description of the Prior Art

Inductive devices, such as transformers, are widely used. Many inductive devices use a bobbin on which a coil of magnet wire is wound. The ends coming from the coil are attached to heavier gauge lead wires for further electrical interconnection. Strain relief members are used at or near the coil wire/lead wire junction, usually on the lead wire side, to prevent breaking of the junction during subsequent assembly and use. The entire assembly is encapsulated in an insulating material with only the free ends of the lead wires exposed.

Assembly of wire junctions and separate strain relief members in this manner is time-consuming, and the quality of the finished product is highly dependent upon the skill of the assembler. In particular, the reliability of such an inductive device depends largely on the quality and reliability of the magnet wire/lead wire connection.

SUMMARY OF THE INVENTION

The present invention relates to a bobbin for an inductive device with an integral strain relief element, or an entirely separate strain relief element, and a method of manufacturing the same. In a preferred embodiment of the invention, the strain relief element is integrally formed as part of the bobbin. The strain relief member has first and second sections separated by a space. The sections have colinear passageways into which a lead wire can be inserted. A free end of the coiled magnet wire is affixed to the end of the lead wire protruding through the passageways in this preferred embodiment by the use of dip-soldering processes. Once affixed, the coil wire/lead wire junction is drawn back into the passageway of the strain relief member where it is to be permanently locked.

In a preferred embodiment of the invention, a wedge block is driven between the lead wire and the bobbin at the space between the first and second sections, thus compressing the lead wire against the internal walls of the passageway adjacent to the gap. With this arrangement, an unusually large amount of external force pulling back on the lead wire would be necessary to break the lead wire/magnet wire connection. Since the lead wire is wedged, any pull on the lead wire is taken up by the wedge (block) so it cannot be pulled back further.

It is therefore an object of this invention to provide a bobbin with a strain relief especially designed for an automated manufacturing process, the bobbin having a low manufacturing cost, and being easy to use.

It is another object to provide a bobbin with a strain relief member which improves and simplifies the manufacture of inductive devices.

These and other objects and advantages of the present invention will become more apparent upon reference to the description and the annexed drawings, in which:

DESCRIPTION OF THE PREFERRED EMBODIMENT

Figure 1:
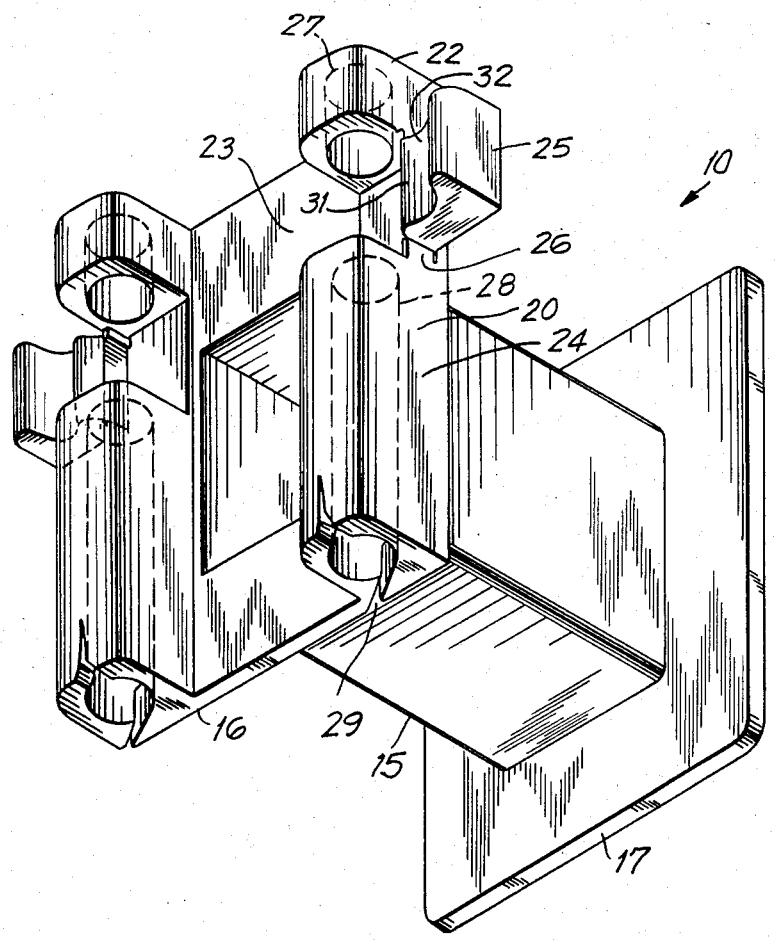
FIG. 1 is a perspective view of a bobbin according to the invention having integral strain relief member.

FIG. 1 shows a bobbin 10 having integral strain relief members 20 according to the present invention. The bobbin has a central core 15 around which a coil of magnet wire (not shown) is to be wound. Flanges 16,17 on each end of the central core 15 serve to keep the magnet wire coil on the core 15 during assembly of the inductive device. While the core 15 and flanges 16,17 are here shown as rectangular, it will be readily understood that the particular shape is illustrative only, and any appropriate shape may be used.

Two strain relief members 20 are shown attached to the flange 16. It will be apparent to those skilled in the art that the number and location of strain relief members 20 on the bobbin 10 will depend upon the particular application. The entire bobbin can be formed by simple and efficient molding steps, which are customary. Furthermore, the strain relief members 20 may be separately formed and then assembled to a bobbin.

Each strain relief member 20 has an upper section 22 into which a stripped lead wire is inserted during assembly of the inductive device and a lower section 24 into which a completed magnet wire/lead wire junction is drawn for strain relief. There is a gap 23 between sections 22 and 24 into which a locking member 25 in the shape of a wedge block for locking the lead wire is placed.

Figure 2:
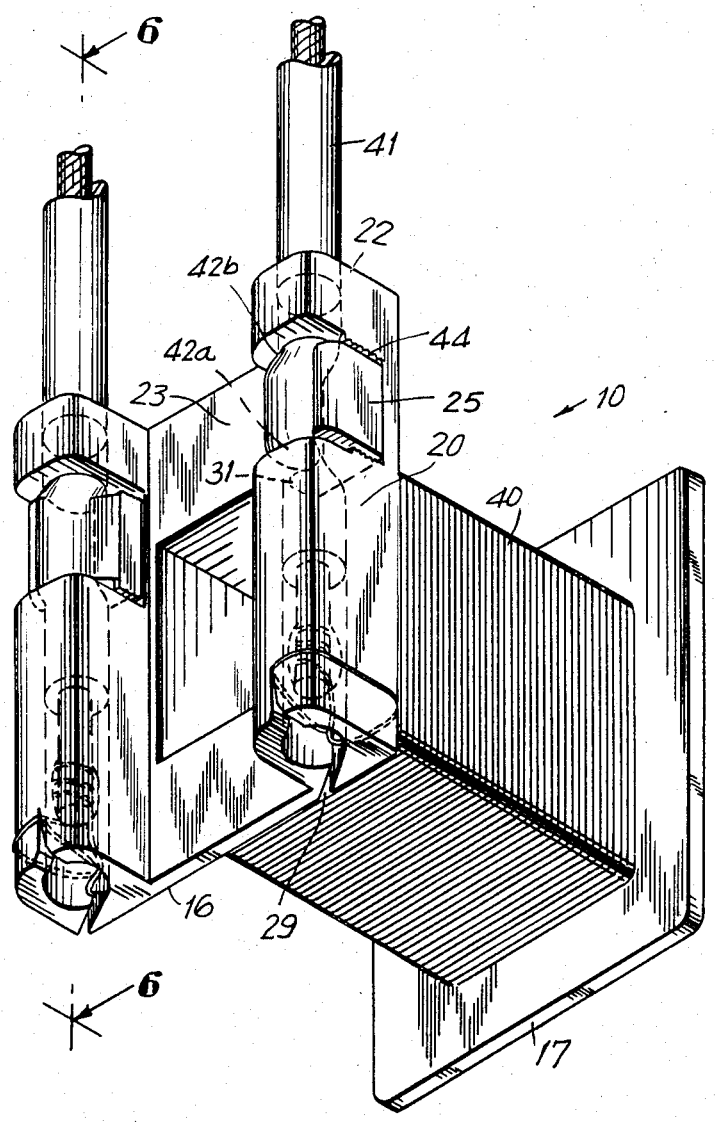
FIG. 2 is a perspective view of the bobbin of FIG. 1 after a coil of magnet wire and lead wires have been assembled thereto.

While two strain relief members are shown in FIGS. 1 and 2, only one will be described. A bore, or wireway 27,28 is formed in both the upper section 22 and the lower section 24. The wireway portions 27,28 are generally at center in the upper and lower sections 22,24, and are colinear. A lead wire passes through the two portions of the wireway 27,28 without any bending required. At the magnet wire/lead wire end of the lower section 24, generally arranged expansion slits 29 are cut into the lower section 24 to accommodate the diameter of magnet wire attached to the lead wire when the magnet wire/lead wire junction is drawn back into the lower section 24.

The upper section 22 is separated from the lower section 24 by a gap 23 for receiving the locking member 25. The locking member 25 is connected at one corner to the upper section 22, and at another corner to the lower section 24, off to the side of the flange 16 by break-away struts 26. This structure ensures reliable placement of the locking member 25 when locking member 25 is driven between a lead wire and the flange surface to lock the lead wire in place and provides for automatic assembly.

The locking member 25 has a ramp 31 and a partially exposed wireway 32 along its length, wireway 32 not co-linear with the wireway portions 27,28 in the upper and lower sections 22,24. Referring to FIG. 2, the bobbin 10 of FIG. 1 is shown, after assembly of magnet wire 40, lead wire 41, and locking of the locking member 25. The struts 26 have been broken away, leaving only pads 44 where the struts 26 were attached. The ramp 31 of locking member 25 has been driven under the lead wire 41 so that the lead wire 41 now rests in the exposed wireway 32. Due to certain predetermined dimensions made more clear below, the lead wire 41 is caused to bend at two places **42*a*,42*b*, and is thus placed in a condition known as "double shear". This double shear locks the lead wire in place, and an unusually large force pulling the lead wire 41** is necessary to break the lead wire/magnet wire connection.

Figure 3:
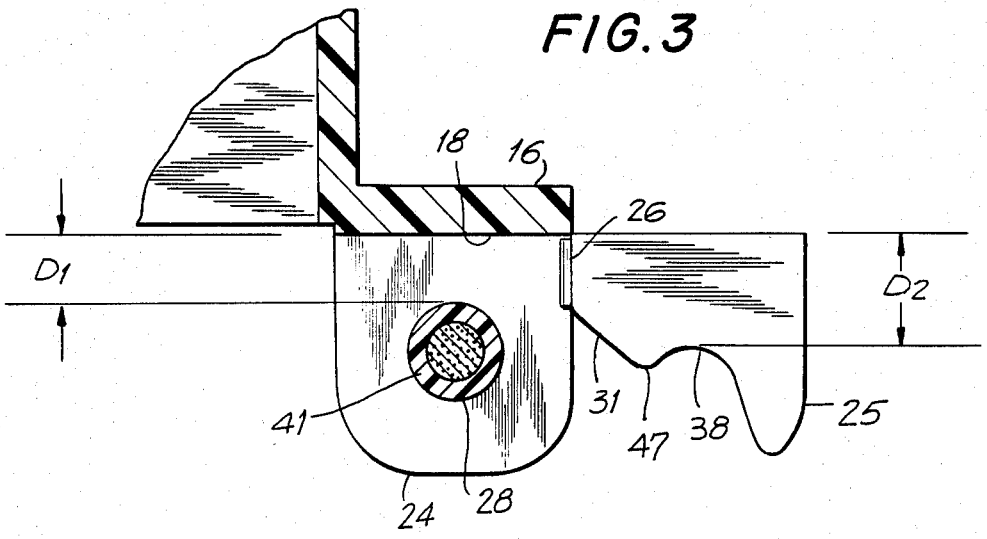
FIG. 3 is a partial sectional view of a strain relief member.

Referring now to FIG. 3, the structure of the locking member 25 is more clearly seen. Attached by struts 26, the locking member 25 has its wireway 32 parallel to the wireway 28 of the lower section 24 (and that of the upper section 22), but offset a greater distance $D_2$ from the near surface 18 of the bobbin flange 16 than the distance $D_1$ (from the lower section wireway 28 to the surface 18 of the flange 16). This dimensional difference is the cause of the double shear condition when the locking member 25 is driven under a lead wire passing through the gap between the upper section 22 and the lower section 24.

Figure 4:
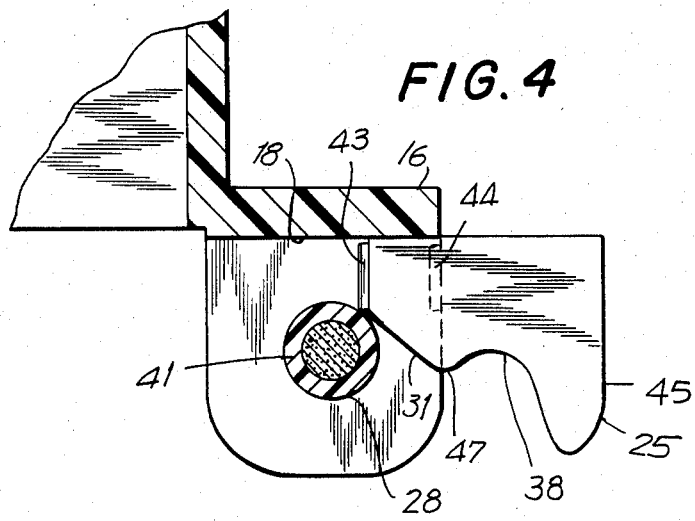
FIG. 4 is a partial sectional view of the strain relief member of FIG. 3, after the wedge block has been driven from its struts, at the moment that the wedge block ramp first contacts a terminal.
Figure 5:
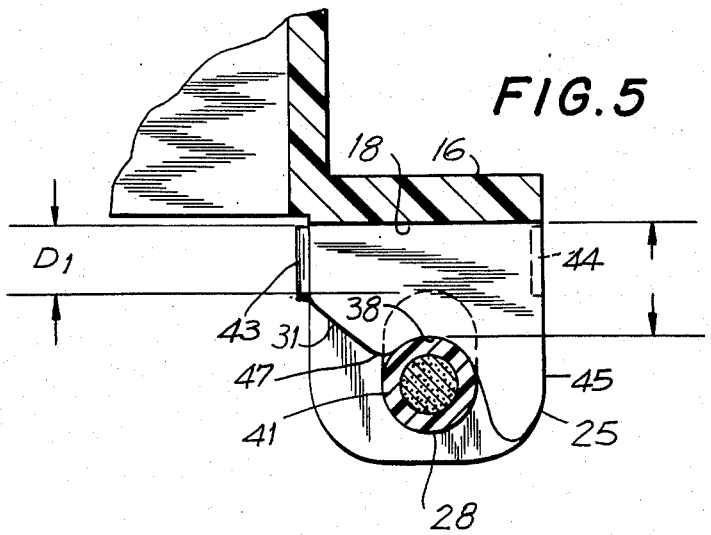
FIG. 5 is a partial sectional view of the strain relief member of FIG. 3, with the wedge block locked in place.

FIG. 4 shows an intermediate stage during the locking of a lead wire 41 into place. The locking member 25 is driven from right to left, as illustrated, by a force applied to the side 45 of the locking member 25. The struts 26 have already broken away in this view, leaving only the pads 43,44 where the struts were attached. In this view, the ramp 31 just contacts the insulation of lead wire 41, and the different offset distances $D_2$, $D_1$ of the wireways 28,32, respectively, are clearly shown. As the locking member 25 is driven further, the lead wire 41 rides up the ramp 31 until it snaps over the peak 47 and becomes locked in the exposed wireway 31, as illustrated in FIG. 5.

Figure 6:
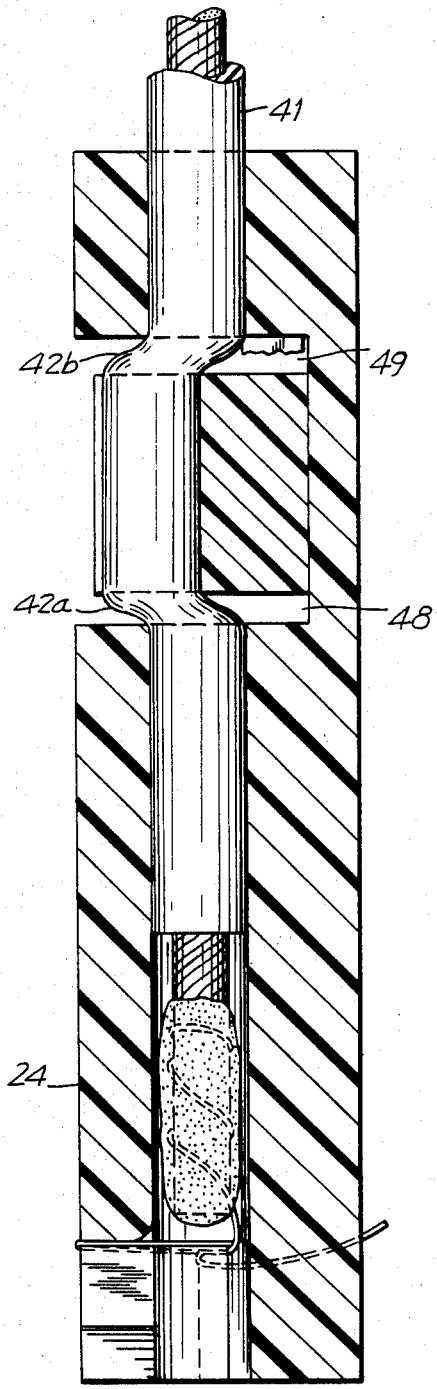
FIG. 6 is a sectional view of the entire strain relief member of FIG. 5, taken along line 6—6 of FIG. 5 and rotated 90° counterclockwise.

Referring to FIG. 6, the "double shear" at the sharp bends **42*a*,42*b* in the lead wire 41 is shown. The lead wire 41 is securely locked in place with the magnet wire/lead wire junction inside the lower section 24. The spaces 48,49 between the locking member 25 and the upper section 22 and lower section 24, respectively, are sufficiently wide to permit the lead wire 41 to bend. Stiffer lead wires will bow upwardly between the sharp bends 42*a*,42*b*, providing additional mechanical resistance against the upper wall of exposed wireway 32**.

Figure 7:
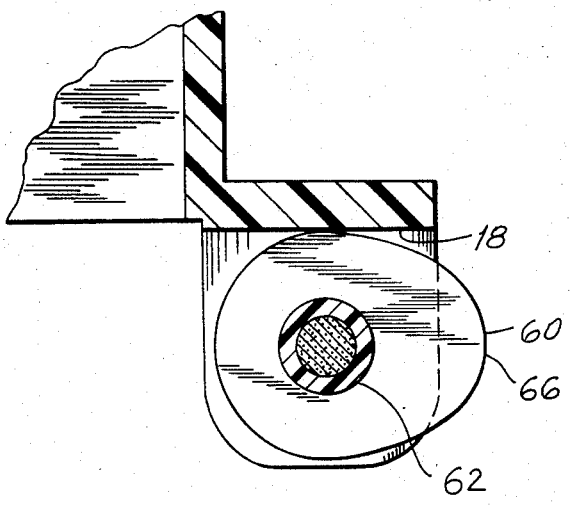
FIG. 7 is a sectional side view of a further ebodiment of strain relief member before locking the lead wire in place.

FIG. 7 shows an alternative structure for a strain relief locking member. In the unlocked position, a rotatable locking member 60 has an off-center passageway 62 through which a lead wire passes, which is colinear with the passageway portion 28 in the lower section 24 of the strain relief element. The offset point 66 of the rotatable locking member 60 is not in direct contact with the bobbin flange surface 18. In this position, the lead wire is passed through the strain relief member.

Figure 8:
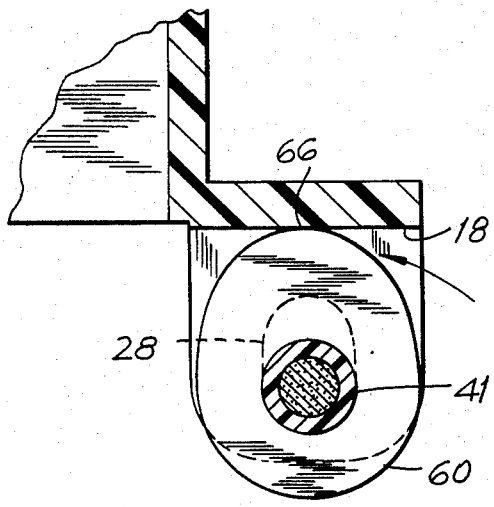
FIG. 8 is a sectional side view of the strain relief member of FIG. 7, after locking the lead wire in place.

FIG. 8 shows the rotatable locking member 60 of FIG. 7 in the locked position. The rotatable member 60 has been rotated so that the offset point 66 is brought into contact with the flange surface 18. The eccentricity of the locking member 60 causes the portion of lead wire 41 which it engages to be offset from the colinear axis of passageway 28, thus producing the desired "double shear" effect at both ends of the rotatable locking member 60. It will be readily apparent to those skilled in the art that many minor variations of the rotatable, as well as the wedge block, locking member may be devised.

Figures 9A, 9B, 9C, 9D, 9E:
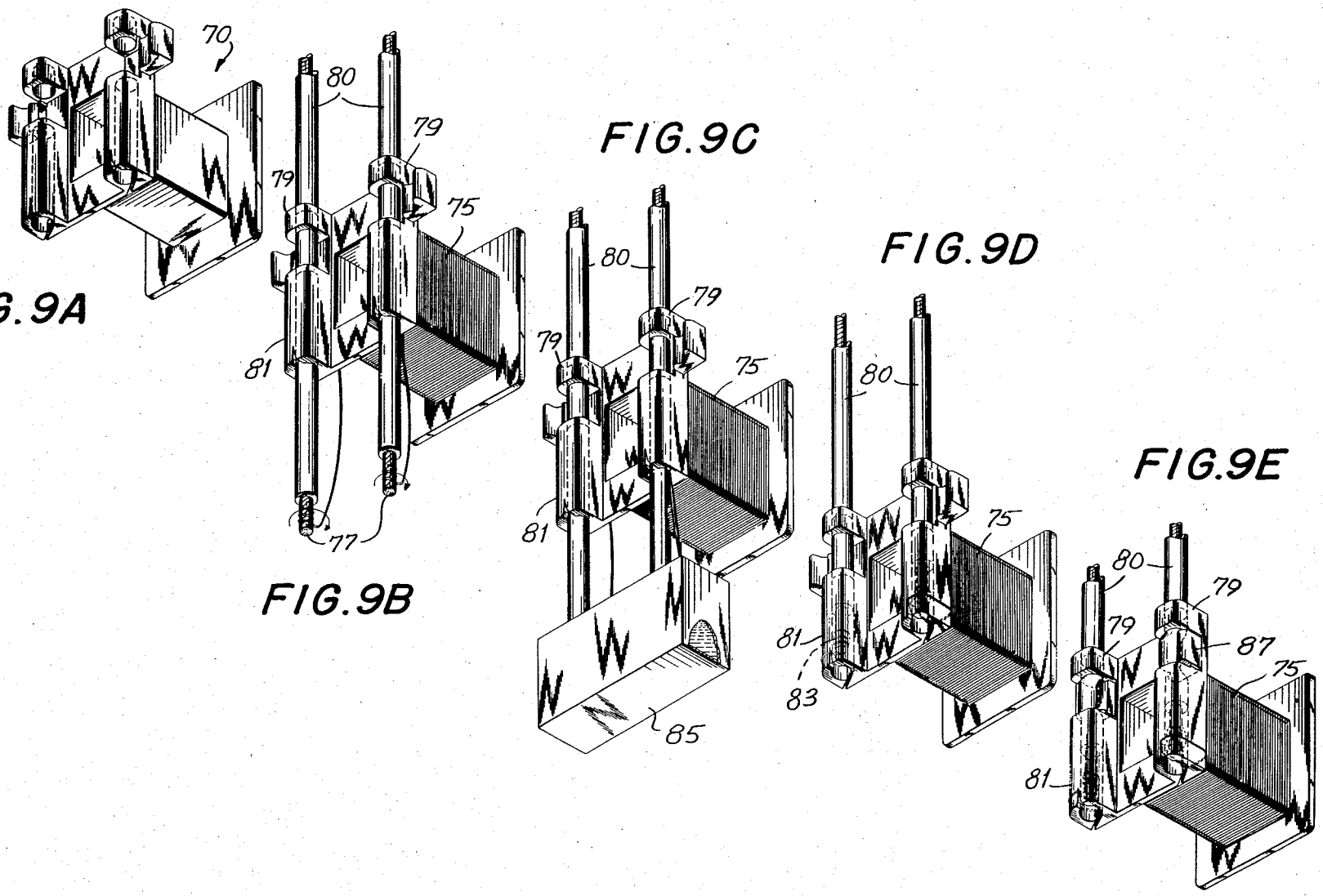
FIGS. 9A–9E are diagrams illustrating an automated process for assembling inductive devices according to the present invention.

FIGS. 9A–9E are diagrams illustrating an automated process for assembling inductive devices using the bobbin of the present invention. FIG. 9A merely shows a bobbin 70 as it would be held on a conventional conveyor assembly line. In FIG. 9B, an intermediate assembly stage is shown, after magnet wire 75 has been wound onto the bobbin 70 to form a winding, and stripped lead wires 80 have been inserted through the colinear passageways of the upper and lower sections 79,81 of the strain relief members. The ends of the coiled magnet wire 75 have additionally been wound around the previously stripped ends 77 of the lead wires 80. FIG. 9C illustrates the use of a dip-soldering tank 85 to electrically and metallurgically attach the magnet wire 75 to the stripped ends of the lead wires 80. FIG. 9D illustrates the inductive device after the completed magnet wire/lead wire junctions 83 have been drawn back into the lower section 81 of the strain relief element. FIG. 9E completes the process, illustrating the locking members, here shown as wedge blocks 87, in their locking positions. The locking members can be driven into the final position by any suitable plunger type mechanism and substantially the entire process can be automated. The completed assembly is now ready for encapsulation in an insulating material so that only the lead wires are exposed.

What is claimed is:

1. A bobin and winding for use in an inductive device, comprising a core surrounded by a coil of wire; strain relief means attached to said core, said strain relief means comprising a first section and a second section spaced from said first section, locking means fitting in the space between said first and second sections, said first and second sections having colinear bores forming passageways through which a lead wire passes, said locking means being movable with respect to said lead wire and a surface between said first and second sections for both (1) engaging the lead wire, and (2) setting the portion of the lead wire it engages off of the colinear axis of the passageways.

2. A bobbin and winding according to claim 1, wherein the bobbin and the strain relief means are molded together as a single integral unit.

3. A bobbin and winding according to claim 2, wherein the locking means is a wedge block, which is force fit into said gap.

4. A bobbin and winding according to claim 3, further comprising break-away members holding the wedge block in its unlocked position.

5. A bobbin and winding according to claim 4, wherein said wedge block includes an inclined ramp section over which the lead wire rides as the wedge block is pushed into the gap for displacing the lead wire from the colinear axis.

6. A bobbin and winding according to claim 3, further comprising a flange for keeping the coil of wire on the core.

7. A bobbin and winding according to claim 4, wherein the strain relief means is attached to the flange.

8. A bobbin and winding according to claim 5, wherein the lead wire is offset from the colinear axis by the wedge block in a direction away from the flange.

9. A bobbin and winding according to claim 3, wherein an end of the coiled wire is attached to an end of the lead wire.

10. A bobbin and winding according to claim 9, wherein the coiled wire and lead wire ends are dip-soldered.

11. A bobbin and winding according to claim 2, wherein the locking means is a rotatable member having an off-center passageway through which the lead wire passes.

12. A bobbin and winding according to claim 11, further comprising a flange for keeping the coil of wire on the core.

13. A bobbin and winding according to claim 12, wherein the strain relief means is attached to the flange.

14. A bobbin and winding according to claim 13, wherein the lead wire is offset from the colinear axis by the rotatable member in a direction away from the flange.

15. A bobbin and winding according to claim 14, wherein an end of the coiled wire is attached to an end of the lead wire.

16. A bobbin and winding according to claim 15, wherein the coiled wire and lead wire ends are dip-soldered.

17. A bobbin and winding for use in an inductive device, comprising:

a core surrounded by a coil of wire;

strain relief means attached to said core, said strain relief means comprising a first section and a second section spaced from said first section, locking means fitting in the space between said first and second sections, said first and second sections having colinear bore forming passageways through which a lead wire passes, said locking means being movable with respect to said lead wire and a surface between said first and second sections for both (1) engaging the lead wire, and (2) setting the portion of the lead wire it engages off of the colinear axis of the passageways; and a flange being included on said core for retaining said wire the passageways.

18. A method of assembling an inductive device having a bobbin with a core and integral strain relief means, said relief means having first and second sections spaced apart with locking means located between and adapted for movement with respect to a surface in the space between the first and second sections, said first and second sections having colinear bores forming passageways formed through them, comprising the steps:

winding a coil of wire onto the core, the coiled wire having a free end;

inserting a lead wire through the colinear passageways;

attaching the free end of the coiled wire to an end of the lead wire to form a coil wire and lead wire junction;

drawing the coil wire and lead wire junction into a portion of the colinear passageways;

moving said locking means to a position engaging the portion of the lead wire between the first and second sections; and offsetting the lead wire from the wire from the colinear axis of the passageway via engagement of said locking means with the former.

19. A method of assembling an inductive device according to claim 18, wherein the step engaging the locking means with the lead wire includes the step:

driving a wedge block between the lead wire and the bobbin.

20. A method of assembling an inductive device according to claim 18, comprising the steps:

inserting the lead wire through a co-linear passageway in the locking means as the lead wire passes through the space between the first and second sections, said locking means being rotatable; and wherein the step of offsetting the lead wire from the co-linear axis is rotating the rotatable locking means.

* * * * *